US012782042B2

(12) United States Patent
Foster

(10) Patent No.: US 12,782,042 B2
(45) Date of Patent: Nov. 3, 2026

(54) REFRIGERATOR APPLIANCE AND METHOD FOR OPERATION

(71) Applicant: Haier US Appliance Solutions, Inc., Wilmington, DE (US)

(72) Inventor: Ronald Gary Foster, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 211 days.

(21) Appl. No.: 18/734,558

(22) Filed: Jun. 5, 2024

(65) Prior Publication Data

US 2025/0377157 A1 Dec. 11, 2025

(51) Int. Cl.
*F25D 29/00* (2006.01)

(52) U.S. Cl.
CPC ..... *F25D 29/005* (2013.01); *F25D 2700/06* (2013.01)

(58) Field of Classification Search
CPC ... F25D 29/005; F25D 2700/06; F25D 25/025
See application file for complete search history.

(56) References Cited

U.S. PATENT DOCUMENTS

| | | | | |
|---|---|---|---|---|
| 10,942,637 | B2 | 3/2021 | Mani et al. | |
| 2007/0244598 | A1* | 10/2007 | Shoenfeld | G16H 20/13 700/236 |
| 2018/0135910 | A1* | 5/2018 | Kim | F25D 29/00 |
| 2018/0158288 | A1 | 6/2018 | Logan et al. | |

FOREIGN PATENT DOCUMENTS

| | | | |
|---|---|---|---|
| CN | 106016902 | B | 6/2019 |
| CN | 115485749 | A | 12/2022 |
| CN | 116255057 | A | 6/2023 |
| EP | 3301388 | A1 | 4/2018 |

* cited by examiner

*Primary Examiner* — Elizabeth J Martin
(74) *Attorney, Agent, or Firm* — Dority & Manning, P.A.

(57) ABSTRACT

A refrigerator appliance and method for operation include a cooled compartment having a plurality of zones including an articulatable feature. A sensor is configured to determine a change in position of the articulatable feature. A computing device is configured to perform operations, including obtaining a user signal corresponding to one or more of the plurality of zones as a restricted zone; obtaining, from the sensor, a sensor signal corresponding to a position of the articulatable feature at the restricted zone; generating a position marker corresponding to the position of the articulatable feature at the restricted zone; comparing the sensor signal to the position marker to determine a change in the position of the articulatable feature at the restricted zone; and transmitting a communications signal corresponding to the change in the position of the articulatable feature at the restricted zone.

20 Claims, 4 Drawing Sheets

REFRIGERATOR APPLIANCE AND METHOD FOR OPERATION

FIELD OF THE INVENTION

The present disclosure is related generally to refrigerator appliances and methods for operation.

BACKGROUND OF THE INVENTION

Users of refrigerator appliances may place food at one or more fresh, frozen, or convertible compartments that the user may desire for another user to not touch or use. For instance, a parent may forbid a child to access one or more compartments, or food thereat. However, if the parent is physically away or not present, the child may use certain foods against the desires of the parent. Accordingly, appliances and methods facilitating enforcement of rules or limitations at the appliance would be advantageous and beneficial.

BRIEF DESCRIPTION OF THE INVENTION

Aspects and advantages of the invention will be set forth in part in the following description, or may be apparent from the description, or may be learned through practice of the invention.

An aspect of the present disclosure is directed to a refrigerator appliance having a cabinet forming a cooled compartment. The cooled compartment includes a plurality of zones, wherein plurality of zones includes an articulatable feature. A sensor is configured to determine a change in position of the articulatable feature at a respective zone of the plurality of zones. A computing device includes a processor and a communications device. The computing device is operably coupled to the sensor. The computing device is configured to perform operations. The operations include obtaining, via the communications device, a user signal corresponding to one or more of the plurality of zones at the refrigerator appliance, wherein the user signal correlates one or more of the plurality of zones as a restricted zone; obtaining, from the sensor, a sensor signal corresponding to a position of the articulatable feature at the restricted zone; generating a position marker corresponding to the position of the articulatable feature at the restricted zone; comparing the sensor signal to the position marker to determine a change in the position of the articulatable feature at the restricted zone; and transmitting, to a remote device, a communications signal corresponding to the change in the position of the articulatable feature at the restricted zone.

An aspect of the present disclosure is directed to a method for operating a refrigerator appliance. The method includes obtaining, via a communications device, a user signal corresponding to one or more of the plurality of zones at the refrigerator appliance, wherein the user signal correlates one or more of a plurality of zones at a cooled compartment of a cabinet as a restricted zone; obtaining, from a sensor configured with a field of view at the restricted zone, a sensor signal corresponding to a position of the articulatable feature at the restricted zone; generating a position marker corresponding to the position of the articulatable feature at the restricted zone; comparing the sensor signal to the position marker to determine a change in the position of the articulatable feature at the restricted zone; and transmitting, to a remote device, a communications signal corresponding to the change in the position of the articulatable feature at the restricted zone.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
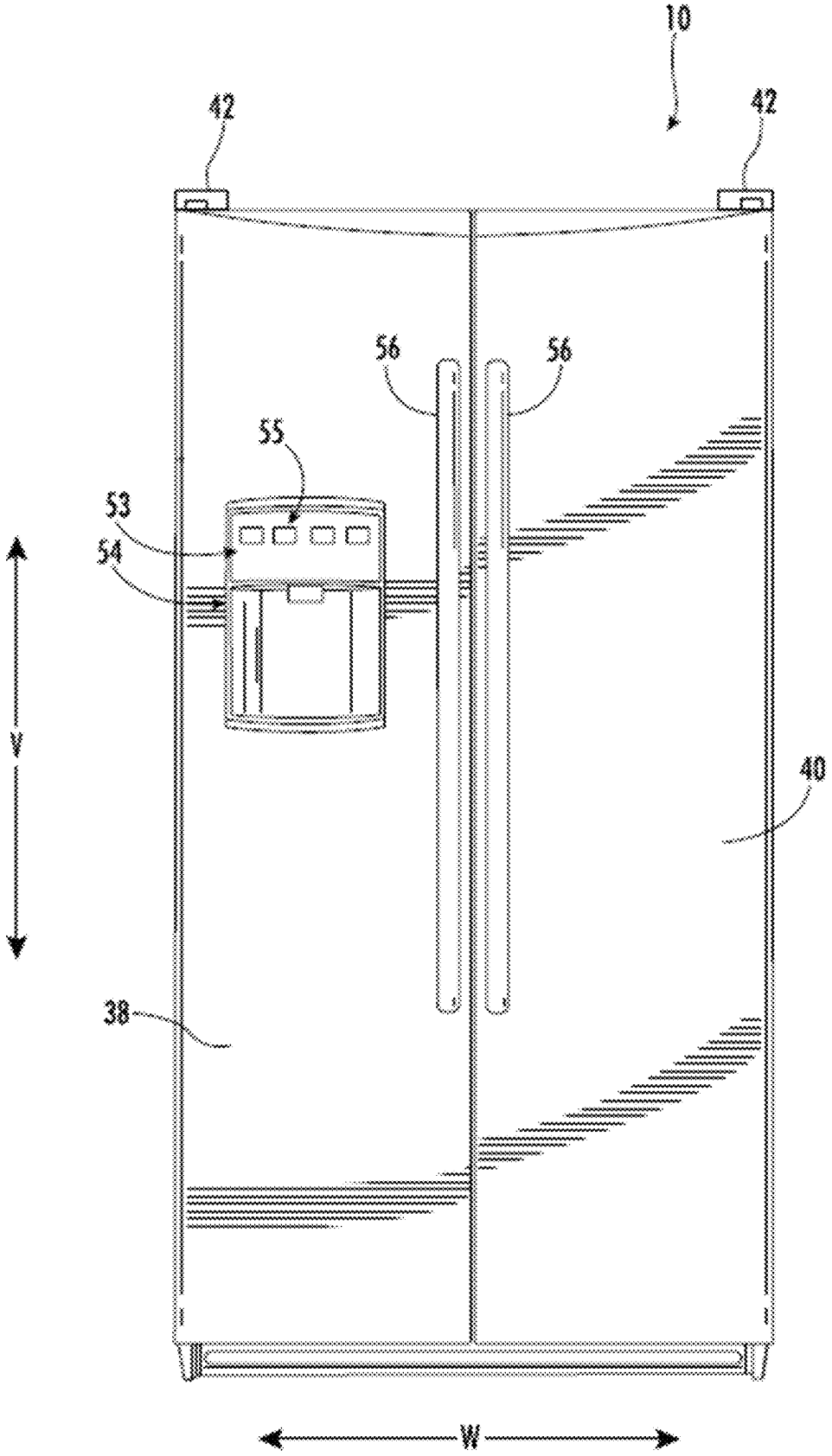
FIG. 1 is a perspective view of a refrigerator appliance according to an exemplary embodiment of the present subject matter with doors of the example refrigerator appliance shown closed.

Repeat use of reference characters in the present specification and drawings is intended to represent the same or analogous features or elements of the present invention.

DETAILED DESCRIPTION

Reference now will be made in detail to embodiments of the present invention, one or more examples of which are illustrated in the drawings. The word "exemplary" is used herein to mean "serving as an example, instance, or illustration." Any implementation described herein as "exemplary" is not necessarily to be construed as preferred or advantageous over other implementations. Moreover, each example is provided by way of explanation, rather than limitation of, the technology. In fact, it will be apparent to those skilled in the art that modifications and variations can be made in the present technology without departing from the scope or spirit of the claimed technology. For instance, features illustrated or described as part of one embodiment can be used with another embodiment to yield a still further embodiment. Thus, it is intended that the present disclosure covers such modifications and variations as come within the scope of the appended claims and their equivalents. The detailed description uses numerical and letter designations to refer to features in the drawings. Like or similar designations in the drawings and description have been used to refer to like or similar parts of the invention.

As used herein, the terms "first", "second", and "third" may be used interchangeably to distinguish one component from another and are not intended to signify location or importance of the individual components. The singular forms "a," "an," and "the" include plural references unless the context clearly dictates otherwise. The terms "coupled," "fixed," "attached to," and the like refer to both direct coupling, fixing, or attaching, as well as indirect coupling, fixing, or attaching through one or more intermediate components or features, unless otherwise specified herein. As used herein, the terms "comprises," "comprising,"

"includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Terms of approximation, such as "about," "generally," "approximately," or "substantially," include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Benefits, other advantages, and solutions to problems are described below with regard to specific embodiments. However, the benefits, advantages, solutions to problems, and any feature(s) that may cause any benefit, advantage, or solution to occur or become more pronounced are not to be construed as a critical, required, or essential feature of any or all the claims.

Figure 2:
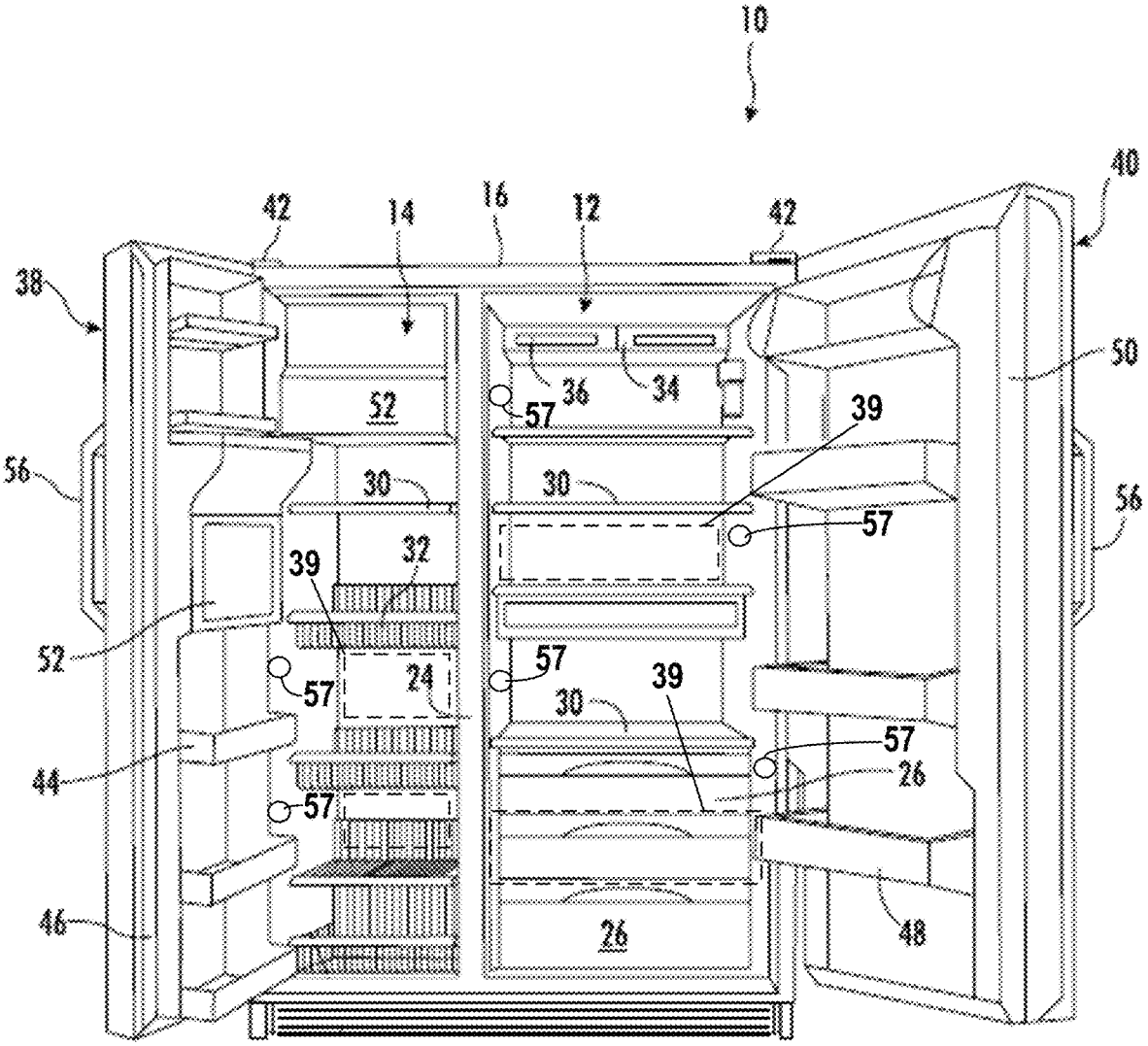
FIG. 2 is a perspective view of the exemplary refrigerator appliance with doors shown open.
Figure 3:
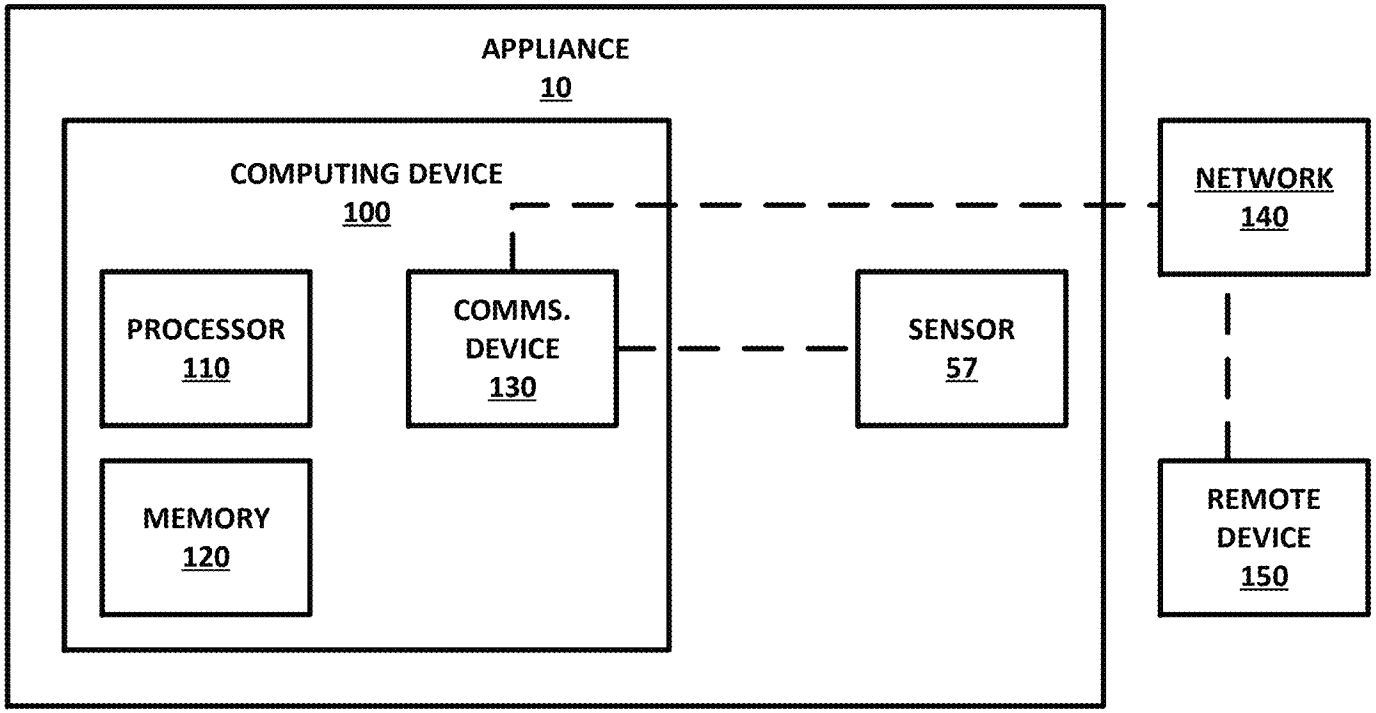
FIG. 3 is a schematic view of a refrigerator appliance according to an exemplary embodiment of the present subject matter.

FIGS. 1-3 depict an appliance 10 according to an exemplary embodiment of the present subject matter. FIGS. 1-2 depict the appliance 10 as a refrigerator appliance. FIG. 3 provides a schematic view of the appliance 10 and a remote user device 150 according to an exemplary embodiment of the present subject matter. The remote user device 150 may include a remote computing device, such as, but not limited to, a smartphone, a tablet computing device, a desktop or laptop computing device, a computing device at an automotive or other vehicle, or other computing device configured to receive and transmit signals over a cloud or internet computing network 140, such as may generally be understood.

FIG. 1 provides an exemplary perspective view of the appliance 10 configured as a side-by-side refrigerator appliance including a refrigeration chamber and a freezer chamber. FIG. 2 provides a perspective view of the appliance 10 of FIG. 1 with doors 38, 40 open to view cooled compartments, such as refrigeration and freezer compartments 12, 14 formed within a cabinet or outer case 16. FIG. 1 provides a reference vertical direction V and width direction W.

Referring to FIG. 2, appliance 10 includes cooled compartments such as the refrigeration compartment 12 and the freezer compartment 14, with the compartments arranged side-by-side and contained within the outer case 16. Appliance 10 may form as any desired configuration of refrigerator appliance, such as a side-by-side style refrigerator appliance, or top-bottom refrigeration and freezer appliance, or including one or more convertible compartments.

Slide-out drawers 26 and shelves 30 are normally provided in refrigeration compartment 12 to support items being stored therein. In addition, a shelf 30, a basket 32, or both, are generally provided in freezer compartment 14.

Referring to FIGS. 1-2, a freezer door 38 and a fresh food door 40 close access openings to freezer compartment 14 and refrigeration compartment 12. Freezer door and fresh food door 38 and 40 are each mounted by a top hinge 42 and a bottom hinge (not shown) to rotate about its outer vertical edge between an open position, as shown in FIG. 1, and a closed position. Freezer door 38 may include a plurality of storage shelves 44 and a sealing gasket 46, and fresh food door 40 also includes a plurality of storage shelves 48 and a sealing gasket 50.

Referring to FIG. 2, the cooled compartments include a plurality of zones 39. Each zone 39 is generally positioned relative to a shelf 30, 44, 48, basket 32, or door 38, 40. An articulatable feature is positioned at the respective zone of the plurality of zones 39. The articulatable feature may include door 38, 40, shelf 30, 44, 48, or basket 32, or items positioned thereat, such as food or foodstuffs positioned on shelves 30, 44, 48, baskets 32, doors 38, 40.

Appliance 10 includes a sensor 57 configured to determine a change in position of the articulatable feature at a respective zone of the plurality of zones 39. Sensor 57 is configured to generate a sensor signal corresponding to a position, or change in position, of the articulatable feature. For instance, sensor 57 is configured to generate a plurality of sensor signals corresponding to a position of the articulatable feature. Comparisons between the plurality of sensor signal may determine a change in position of the articulatable structure, such as opening/closing of the shelves, baskets, or doors, or taking, removing, or returning a foodstuff from the shelf, basket, or door.

In various embodiments, sensor 57 includes a proximity sensor configured to determine a position, or change therein, of the articulatable feature. Sensor 57 may be configured to determine a change in position of door 38, 40, shelf 30, 44, 48, or basket 32, such as whether the door, shelf, or basket slides, opens/closes, rotates, or is otherwise moved by a user.

In still various embodiments, sensor 57 includes an imaging device configured to determine a position of the articulatable feature. Sensor 57 may be configured to obtain an image of the articulatable feature, such as the foodstuff, shelf, basket, or door.

Freezer compartment 14 may include an automatic ice maker 52 and a dispenser assembly 54 provided in freezer door 38 such that ice and/or chilled water can be dispensed without opening freezer door 38, as is well known in the art. Freezer door and fresh food door 38 and 40 may be opened by handles 56. It should be appreciated that the dispenser assembly 54 may be positioned at an exterior portion of the door, such as depicted in FIG. 1, or positioned in an interior portion, such as to require opening the door to access the dispenser assembly 54. The dispenser assembly 54 may include a user interface 53

Appliance 10 also includes a machinery compartment (not shown) that includes one or more operational components. For instance, the machinery compartment may at least partially contain a cooling system including components for executing a known vapor compression cycle for cooling air. The cooling system may include a compressor, a condenser, an expansion device, and an evaporator connected in series as a loop and charged with a refrigerant. The evaporator is a type of heat exchanger which transfers heat from air passing over the evaporator to the refrigerant flowing through the evaporator, thereby causing the refrigerant to vaporize. The cooled air is used to refrigerate one or more refrigerator or freezer compartments via fans. Also, a cooling loop can be added to direct cool the ice maker to form ice cubes, and a heating loop can be added to help remove ice from the ice maker. Collectively, the vapor compression cycle components in a refrigeration circuit, associated fans, and associated compartments are conventionally referred to as a sealed system. The construction and operation of the sealed system are well known to those skilled in the art.

Although the appliance 10 of FIGS. 1-2 is depicted and described as a side-by-side refrigerator appliance, it should be appreciated that present disclosure may apply to other refrigerator appliance configurations, such as, but not limited to, top-bottom configurations, two-compartment configurations, three-compartment compartment configurations, dispenser assembly within the cabinet, refrigerator-only configuration, freezer-only configuration, etc. Furthermore, as provided herein, appliance 10 may be configured as other commercial or household appliances, such as, but not limited to, stovetop or oven cooking appliances, microwave appliances, dishwasher appliances, laundry appliances, etc.

Referring now to FIG. 3, a schematic view of an exemplary embodiment of appliance 10 is provided. Appliance 10 includes a computing device 100 configured to receive or store instructions that, when executed, cause the appliance 10, or operational components thereof, to perform operations. In various embodiments, appliance 10 features are regulated with computing device 100. Input/output ("I/O") signals may be routed between computing device 100 and various operational components of appliance 10. The operational components may be in communication with computing device 100 via one or more wired or wireless signal lines or shared communication busses.

Sensor 57 is configured with a field of view toward one or more zones 39 at the cooled compartment. Sensor 57 is communicatively coupled to computing device 100 to transmit sensor signals, such as electrical signals corresponding to images, proximity, sound or pressure, obtained by sensor 57. In some embodiments, sensor 57 includes a camera or other device configured to generate an electronic or digital image within the field of view.

Computing device 100 can include any device that includes one or more processors 110 and memory 120. As an example, in some embodiments, computing device 100 may be a single board computer (SBC). For example, computing device 100 can be a single System-On-Chip (SOC). However, any form of computing device 100 may also be used to perform the present subject matter. The processor(s) 110 can be any suitable processing device, such as a microprocessor, microcontroller, integrated circuit, or other suitable processing devices or combinations thereof. The memory 120 can include any suitable storage media, including, but not limited to, non-transitory computer-readable media, RAM, ROM, hard drives, flash drives, accessible databases, or other memory devices. The memory 120 can store information accessible by processor(s) 110, including instructions that can be executed by processor(s) 110 to perform aspects of the present disclosure, such as steps of method 1000 provided herein.

Computing device 100 includes a communications device 130 configured to receive and transmit communications signals. The communications device 130 may be configured as any suitable wired or wireless communications module. For instance, communication device 130 may be configured to emit and/or receive one or more signals and communicate over a network 140, such as an internet, wide area or local area network. For example, the communications device 130 may be configured to receive and transmit communications signals over the network 140 to or from the remote device 150. A wired or wireless communications bus communicatively connects the sensor 57 to the computing device 100, such as to obtain sensor signals from the sensor 57 and transmit communications signals to the remote device 150 in accordance with steps of method 1000 described herein.

Figure 4:
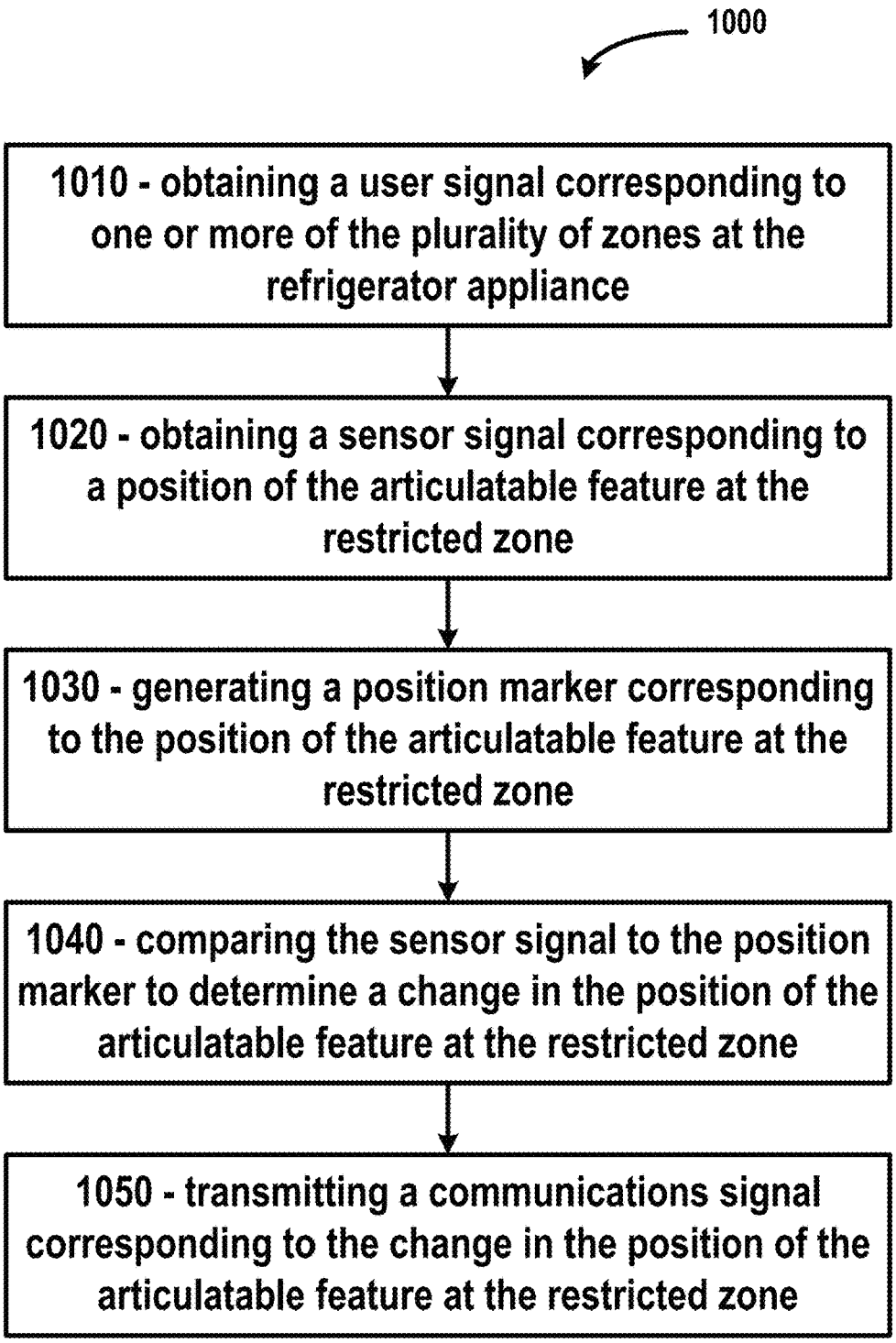
FIG. 4 is a flowchart outlining steps of a method for operating a refrigerator appliance according to an exemplary embodiment of the present subject matter.

Referring now to FIG. 4, a flowchart outlining steps of a method for operating a refrigerator appliance is provided (herein, "method 1000"). Steps of method 1000 may be stored as instructions at a computing device, such as at memory 120 of computing device 100, or distributed across one or more computing devices at network 140 or remote device 150. Method 1000 may be executed at embodiments of appliance 10 depicted and described herein. However, it should be appreciated that other method 1000 may be performed at other embodiments of a refrigerator appliance.

Method 1000 includes at 1010 obtaining a user signal corresponding to one or more of the plurality of zones (e.g., zones 39) at the refrigerator appliance (e.g., at cooled compartment 12, 14). The user signal correlates one or more of the plurality of zones as a restricted zone. In various embodiments, a user may utilize a user interface at the remote device 150 to designate one or more of the plurality of zones 39 as a restricted zone. Remote device 150 connected to network 140 transmits the user signal to appliance 10, such as via communications device 130.

Method 1000 includes at 1020 obtaining a sensor signal corresponding to a position of the articulatable feature at the restricted zone. Sensor 57 is communicatively coupled to computing device 100 to transmit a sensor signal, such as an image or proximity sensor, corresponding to a position of foodstuffs, shelves, drawers, baskets, or doors corresponding to the designated restricted zone 39 at the cooled compartment 12, 14. In various embodiments, the user signal designating the restricted zone includes a period of time over which the one or more of the plurality of zones 39 is designated as the restricted zone.

Method 1000 may include obtaining an initial sensor signal corresponding to an initial position of the articulatable feature (e.g., foodstuffs, shelves, drawers, baskets, doors at the restricted zone). Obtaining the initial sensor signal (e.g., via sensor 57) corresponds to an initiation of designation of the restricted zone 39, or a period of time over which the restricted zone is designated. For instance, the period of time may extend from $T_0$ to $T_{END}$ (e.g., over a period of one hour, or two hours, or several hours, or portions of an hour, etc.). Obtaining the initial sensor signal may correspond to $T_0$ of the period of time over which the restricted zone is designated.

Method 1000 may include obtaining one or more second sensor signals corresponding to an opening of a door (e.g., door 38, 40) to the respective cooled compartment (e.g., compartment 12, 14). For instance, sensor 57 may include a proximity sensor configured to determine opening/closing of the door 38, 40, shelf 30, 44, 48, or basket 32. Sensor 57 may include an imaging device configured to obtain the sensor signal corresponding to an image of the articulatable feature.

Method 1000 includes at 1030 generating a position marker corresponding to the position of the articulatable feature at the restricted zone. The position marker may include a digital marker superimposed onto the sensor signal. For instance, the position marker may be digitally superimposed onto a digital image of a field of view from the sensor 57 including one or more articulatable features (e.g., foodstuffs, shelves, drawers, baskets, doors, etc.). Method 1000 at 1030 may include generating and superimposing the position marker onto the initial sensor signal and the one or more second sensor signals.

Method 1000 includes at 1040 comparing the sensor signal to the position marker to determine a change in the position of the articulatable feature at the restricted zone. Comparing the sensor signal to the position marker may include comparing an initial position of the position marker (e.g., corresponding to the initial sensor signal) to a second position of the position marker (e.g., corresponding to the second sensor signal). A change in the position markers indicates change of position of the articulatable feature, such as foodstuffs, drawers, shelves, baskets, or doors at the restricted zone being moved or utilized by a user.

Method 1000 includes at 1050 transmitting a communications signal corresponding to the change in the position of the articulatable feature at the restricted zone. Communications device 130 is configured to transmit the communications signal to the remote device 150, such as via the network 140, indicating that the articulatable feature at the restricted zone has been changed. For instance, the change in position of the articulatable feature may indicate change, usage, or consumption of foodstuffs at drawers, shelves, baskets, or doors at the restricted zone. The communications signal may include a visual signal (e.g., an image or video), an audio signal, or combination thereof, transmitted to the remote device 150 to indicate usage at the restricted zone.

Embodiments of the appliance 10 and method 1000 described herein may allow a user to designate a portion of the refrigerator appliance at which another user is restricted or forbidden from entering or using foodstuffs. For instance, embodiments of method 1000 may form an "after school mode" in which a user (e.g., parent) obtains communications signals when another user (e.g., child) enter a restricted shelf, drawer, basket, or door at the appliance, or touch or use a foodstuff at the restricted zone. The parent user may inform the child that certain portions of the refrigerator appliance are forbidden or restricted from the child. The parent designates a restricted zone corresponding to the forbidden portion communicated to the child. Entry into areas or usage of foodstuffs from the restricted zone is communicated to the parent user. In another instance, embodiments of method 1000 may form a surveillance mode in which a user obtains communications signals when another user touches or uses foodstuffs at the restricted zone. For instance, the user may position a lunch at a community refrigerator (e.g., at a workplace or school) and designate a restricted zone corresponding to where the user's food is positioned. Access and changes at the restricted zone generate and transmit the communications signal to the user, such as may indicate whether a person used the user's food (e.g., lunch or snack).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, the refrigerator appliance comprising:

a cabinet forming a cooled compartment, wherein the cooled compartment comprises a plurality of zones, wherein plurality of zones comprise an articulatable feature;

a sensor configured to determine a change in position of the articulatable feature at a respective zone of the plurality of zones;

a computing device comprising a processor and a communications device, the computing device operably coupled to the sensor, wherein the computing device is configured to perform operations, the operations comprising:

obtaining, via the communications device, a user signal corresponding to one or more of the plurality of zones at the refrigerator appliance, wherein the user signal identifies one or more of the plurality of zones as a restricted zone;

obtaining, from the sensor, a sensor signal corresponding to a position of the articulatable feature at the restricted zone;

generating a position marker corresponding to the position of the articulatable feature at the restricted zone;

comparing the sensor signal to the position marker to determine a change in the position of the articulatable feature at the restricted zone; and transmitting, to a remote device, a communications signal corresponding to the change in the position of the articulatable feature at the restricted zone.

2. The refrigerator appliance of claim 1, wherein the user signal comprises a period of time over which the one or more of the plurality of zones as the restricted zone.

3. The refrigerator appliance of claim 1, wherein the articulatable feature comprises a drawer at the cooled compartment.

4. The refrigerator appliance of claim 1, wherein the articulatable feature comprises a foodstuff at a drawer at the cooled compartment.

5. The refrigerator appliance of claim 1, wherein the sensor comprises a proximity sensor.

6. The refrigerator appliance of claim 1, wherein the sensor comprises an imaging device.

7. The refrigerator appliance of claim 1, wherein the communications signal is a visual signal, an audio signal, or combination thereof.

8. The refrigerator appliance of claim 1, the operations comprising:

obtaining an initial sensor signal corresponding to an initial position of the articulatable feature.

9. The refrigerator appliance of claim 8, the operations comprising:

obtaining one or more second sensor signals corresponding to an opening of a door to the respective cooled compartment.

10. The refrigerator appliance of claim 9, the operations comprising:

generating and superimposing the position marker onto the initial sensor signal and the one or more second sensor signals.

11. The refrigerator appliance of claim 9, the operations comprising:

comparing an initial position of the position marker corresponding to the initial sensor signal to a second position of the position marker corresponding to the second sensor signal to determine a change of the articulatable feature.

12. A method for operating a refrigerator appliance, the method comprising:

obtaining, via a communications device, a user signal corresponding to one or more of the plurality of zones at the refrigerator appliance, wherein the user signal identifies one or more of a plurality of zones at a cooled compartment of a cabinet as a restricted zone;

obtaining, from a sensor configured with a field of view at the restricted zone, a sensor signal corresponding to a position of the articulatable feature at the restricted zone;

generating a position marker corresponding to the position of the articulatable feature at the restricted zone;

comparing the sensor signal to the position marker to determine a change in the position of the articulatable feature at the restricted zone; and transmitting, to a remote device, a communications signal corresponding to the change in the position of the articulatable feature at the restricted zone.

13. The method of claim 12, wherein the user signal comprises a period of time over which the one or more of the plurality of zones as the restricted zone.

14. The method of claim 12, wherein the articulatable feature comprises a drawer at the cooled compartment.

15. The method of claim 12, wherein the articulatable feature comprises a foodstuff at a drawer at the cooled compartment.

16. The method of claim 12, wherein the sensor comprises a proximity sensor or an imaging device.

17. The method of claim 12, the method comprising:

obtaining an initial sensor signal corresponding to an initial position of the articulatable feature.

18. The method of claim 17, the method comprising:

obtaining one or more second sensor signals corresponding to an opening of a door to the respective cooled compartment.

19. The method of claim 18, the method comprising:

generating and superimposing the position marker onto the initial sensor signal and the one or more second sensor signals.

20. The method of claim 18, the method comprising:

comparing an initial position of the position marker corresponding to the initial sensor signal to a second position of the position marker corresponding to the second sensor signal to determine a change of the articulatable feature.

* * * * *